US010858865B2

(12) United States Patent
Kelsch et al.

(10) Patent No.: US 10,858,865 B2
(45) **Date of Patent: *Dec. 8, 2020**

(54) ANTI-THEFT DEVICE WITH ADJUSTABLE LOCKING ARMS FOR SECURING AN ARTICLE OF MERCHANDISE

(71) Applicants: Christopher A. Kelsch, Palm Harbor, FL (US); Vanguard Products Group, Inc., Oldsmar, FL (US)

(72) Inventors: Christopher A. Kelsch, Palm Harbor, FL (US); John N. Figh, Jr., Oldsmar, FL (US); Matthew Kuntz, Tampa, FL (US); Lucas P. Swartwood, San Jose, CA (US); Wade Zhu, Westchase, FL (US); Volodymyr Andreev, Lviv (UA); Peter D. Iezzi, Coral Springs, FL (US); Andriy Los, Lviv (UA)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/458,967

(22) Filed: Jul. 1, 2019

(65) Prior Publication Data

US 2020/0040614 A1 Feb. 6, 2020

Related U.S. Application Data

(63) Continuation-in-part of application No. 16/050,696, filed on Jul. 31, 2018, now Pat. No. 10,378,248.

(51) Int. Cl.
*E05B 73/00* (2006.01)
*E05B 47/00* (2006.01)

(52) U.S. Cl.
CPC ..... *E05B 73/0023* (2013.01); *E05B 73/0017* (2013.01); *E05B 73/0082* (2013.01); *E05B 2047/002* (2013.01)

(58) Field of Classification Search
CPC .... E05B 53/008; E05B 73/00; E05B 73/0017; E05B 73/0029; E05B 73/0082;
(Continued)

(56) References Cited

U.S. PATENT DOCUMENTS 5,715,711 A 2/1998 Jennison
6,237,375 B1 * 5/2001 Wymer ..... E05B 73/0082 248/551

(Continued)

*Primary Examiner* — Christopher J Boswell
(74) *Attorney, Agent, or Firm* — Andriy Lytvyn; Smith & Hopen, P.A.

(57) ABSTRACT

An anti-theft device for securing an article of merchandise against unauthorized removal from a display counter. The anti-theft device includes two pairs of arms slidingly disposed within the housing. Grips are disposed on distal ends of the arms and are configured to receive and secure edges of an article of merchandise. A locking mechanism is disposed within the housing of the anti-theft device. Complimentary gear teeth are disposed on the outer surface of the locking component and the inner edges of the arms. An actuator transitions the locking components between a first unlocked configuration in which the gear teeth of the locking components are retracted away from the gear teeth of the arms, and a second locked configuration in which the gear teeth of the locking components engage the gear teeth of the arms.

23 Claims, 11 Drawing Sheets

(58) Field of Classification Search
CPC ..... E05B 2047/002; E05B 2047/0021; E05B 2047/0022; F16H 27/02
See application file for complete search history.

(56) References Cited

U.S. PATENT DOCUMENTS

| | | | | |
|---|---|---|---|---|
| 8,464,563 | B2 * | 6/2013 | Perez | E05B 73/0023 206/308.2 |
| 8,711,553 | B2 * | 4/2014 | Trinh | E05B 73/0082 248/206.5 |
| 9,097,380 | B2 * | 8/2015 | Wheeler | E05B 73/0017 |
| 9,161,466 | B2 * | 10/2015 | Huang | E05B 73/0082 |
| 9,334,679 | B2 * | 5/2016 | Lin | E05B 73/0082 |
| 9,797,543 | B2 * | 10/2017 | Lin | E05B 73/0082 |
| 9,936,823 | B2 * | 4/2018 | Galant | E05B 73/0082 |
| 10,001,153 | B1 * | 6/2018 | Fan | F16M 11/041 |
| 2010/0079285 | A1 * | 4/2010 | Fawcett | E05B 73/0005 340/568.1 |
| 2012/0312936 | A1 | 12/2012 | Huang | |
| 2015/0129724 | A1 | 5/2015 | Kohmoto et al. | |
| 2016/0201359 | A1 | 7/2016 | Berglund et al. | |
| 2017/0206757 | A1 | 7/2017 | Grant et al. | |

* cited by examiner

ANTI-THEFT DEVICE WITH ADJUSTABLE LOCKING ARMS FOR SECURING AN ARTICLE OF MERCHANDISE

CROSS-REFERENCE TO RELATED APPLICATIONS

This Continuation-In-Part application claims priority to Nonprovisional application Ser. No. 16/050,696, entitled "ANTI-THEFT DEVICE WITH ADJUSTABLE LOCKING ARMS FOR SECURING AN ARTICLE OF MERCHANDISE," filed Jul. 31, 2018.

BACKGROUND OF THE INVENTION

1. Field of the Invention

This invention relates to merchandise anti-theft devices. More specifically, it relates to an anti-theft device having adjustable arms and a locking mechanism for securing an article of merchandise against unauthorized removal from a display counter.

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma pertaining to how to interactively display their merchandise to attract customers and increase sales, while, at the same time, safeguarding the merchandise against theft.

Several anti-theft devices are currently known in the art, but they have serious flaws. One example of an existing anti-theft device is disclosed in a published PCT application WO 2011/032147. The device includes a housing that attaches to the back cover of the gadget via an adhesive layer. Two arms extend laterally from the housing and grasp the opposite edges of the gadget, thereby securing it within the clamp. This anti-theft device, however, has a serious flaw: many electronic gadgets have removable back covers, which makes them vulnerable to theft because thieves can easily circumvent this anti-theft device by simply removing the back cover of the gadget and sliding the gadget out of the grasping arms. This flaw significantly undermines the efficacy of this device rendering it inadequate for many electronic gadgets.

Other currently available anti-theft solutions involve obtrusive and aesthetically unattractive devices such as steel cables, locks, and casings. Although these security measures may effectively protect against theft, they have a negative effect on the consumers by discouraging interaction with products and may ruin the overall ambiance of a retail store. Accordingly, there exists an unresolved need for a discrete and effective anti-theft device that adequately secures an electronic gadget while allowing the prospective purchasers to fully experience the gadget without obstructing access to any of the gadget's functional features, including the front screen.

SUMMARY OF THE INVENTION

The invention pertains to an anti-theft security device that involves two sets of adjustable bracket arms having grips configured to receive opposite edges of an article of merchandise. The two sets of adjustable arms are in an orthogonal relationship with one another. Each arm is independently adjustable by sliding in and out relative to the housing of the anti-theft device. A flange is located on each arm preventing the arms from being removed from the housing. The four adjustable arms are spaced apart such that their inner edges define a rectangular aperture. Each inner edge has a plurality of gear teeth disposed therealong.

A locking mechanism is disposed within the housing and within the rectangular aperture defined by the bracket arms. The locking mechanism comprises a frustoconical shape. A biasing member urges the locking component toward an unlocked position. The locking component has gear teeth configured to interlock with the gear teeth disposed on the inner edges of the arms. When the locking component is retracted from the arms, the gear teeth of the locking component disengage the gear teeth on the arms—this is the unlocked configuration. In the unlocked configuration, the bracket arms are free to slide with respect to the housing, but a flange located on the proximal end portion of each arm prevents the arms from being removed from the housing. This enables the arms to adjust to accommodate the geometry of the article of merchandise, such that the grips secure the edges thereof, but prevents the operator from misplacing or dropping one or more of the arms during operation, storage, or transport of the security device.

The top surface of the locking component has a funnel-like opening with an actuator having a pointed end disposed over this funnel-like opening. The actuator is configured to translate along the center axis thereof in an inward direction relative to the housing. As the actuator translates inwardly, its pointed end engages the funnel-like opening applying a force having a component opposite to the biasing force retaining the locking component. Thus, as the set screw is translated inwardly with respect to the housing, the locking component translates vertically against the biasing force. The gear teeth of the locking component engage the gear teeth disposed on the inner edges of the adjustable arms, thereby immobilizing the arms with respect to the housing.

When the arms are immobilized, the anti-theft device is in its locked configuration. To transition the anti-theft device into the unlocked configuration, the actuator must be translated outwardly with respect to the housing. As the actuator disengages the funnel-like opening of the locking component, the biasing force exerted onto the locking component by the biasing element urges the locking component vertically and away from the arms, thereby disengaging the gear teeth of the locking component from the gear teeth of the arms. In this unlocked configuration, the arms can slide relative to the housing, thereby releasing the grips from edges of the article of merchandise.

A locking mechanism is disposed within the housing and within the rectangular aperture defined by the inner edges of the bracket arms. The locking mechanism comprises two locking components in a sliding relationship with one another. A biasing member urges the two locking components toward one another such that their surfaces mate. The locking components have gear teeth configured to interlock with the gear teeth disposed on the inner edges of the arms. When the locking components are retracted from the arms, the gear teeth of the locking components disengage the gear teeth on the arms—this is the unlocked configuration. In the unlocked configuration, the bracket arms are free to slide with respect to the housing, thereby enabling the arms to adjust to accommodate the geometry of the article of merchandise, such that the grips secure the edges thereof.

The inner edges of the locking components have complementary notches, which form a funnel-like opening when the two locking components are in a mated configuration. An actuator having a pointed end is disposed over this funnel-like opening. The actuator is configured to translate along the center axis thereof in an inward direction relative to the housing. As the actuator translates inwardly, its pointed end engages the notches applying a force that opposes the biasing force retaining the locking components in a mated configuration. Thus, as the actuator is translated inwardly with respect to the housing, the locking components are displaced apart against the biasing force. When the locking components are displaced, the gear teeth of the locking components engage the gear teeth disposed on the inner edges of the adjustable arms, thereby immobilizing the arms with respect to the housing.

When the arms are immobilized, the anti-theft device is in its locked configuration. To transition the anti-theft device into the unlocked configuration, the actuator must be translated outwardly with respect to the housing. As the actuator disengages the notches of the locking components, the biasing force exerted onto the locking components by the biasing element urges the locking components toward one another and away from the arms, thereby disengaging the gear teeth of the locking components from the gear teeth of the arms. In this unlocked configuration, the arms can slide relative to the housing, thereby releasing the grips from edges of the article of merchandise.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
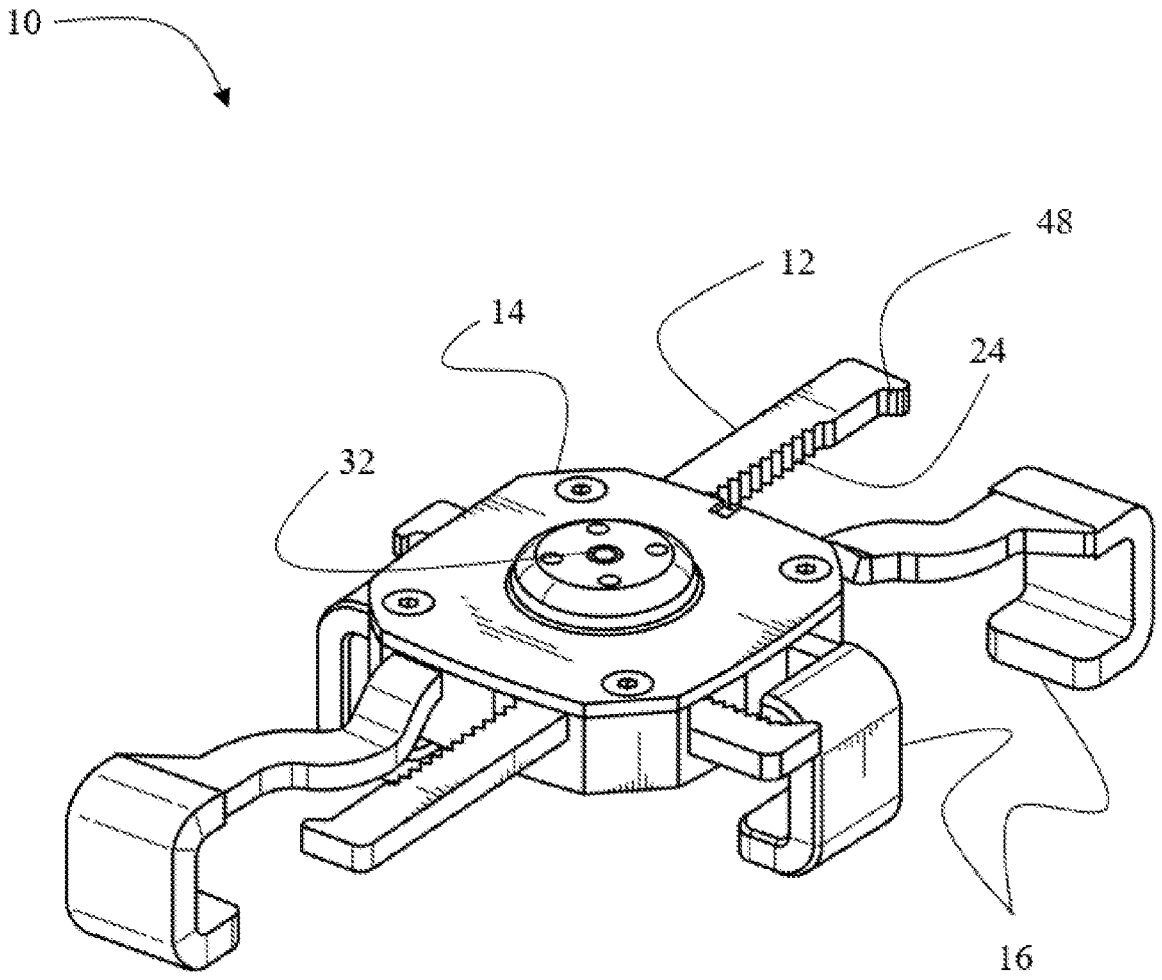
FIG. 1A is a perspective view of the anti-theft device.
Figure 1B:
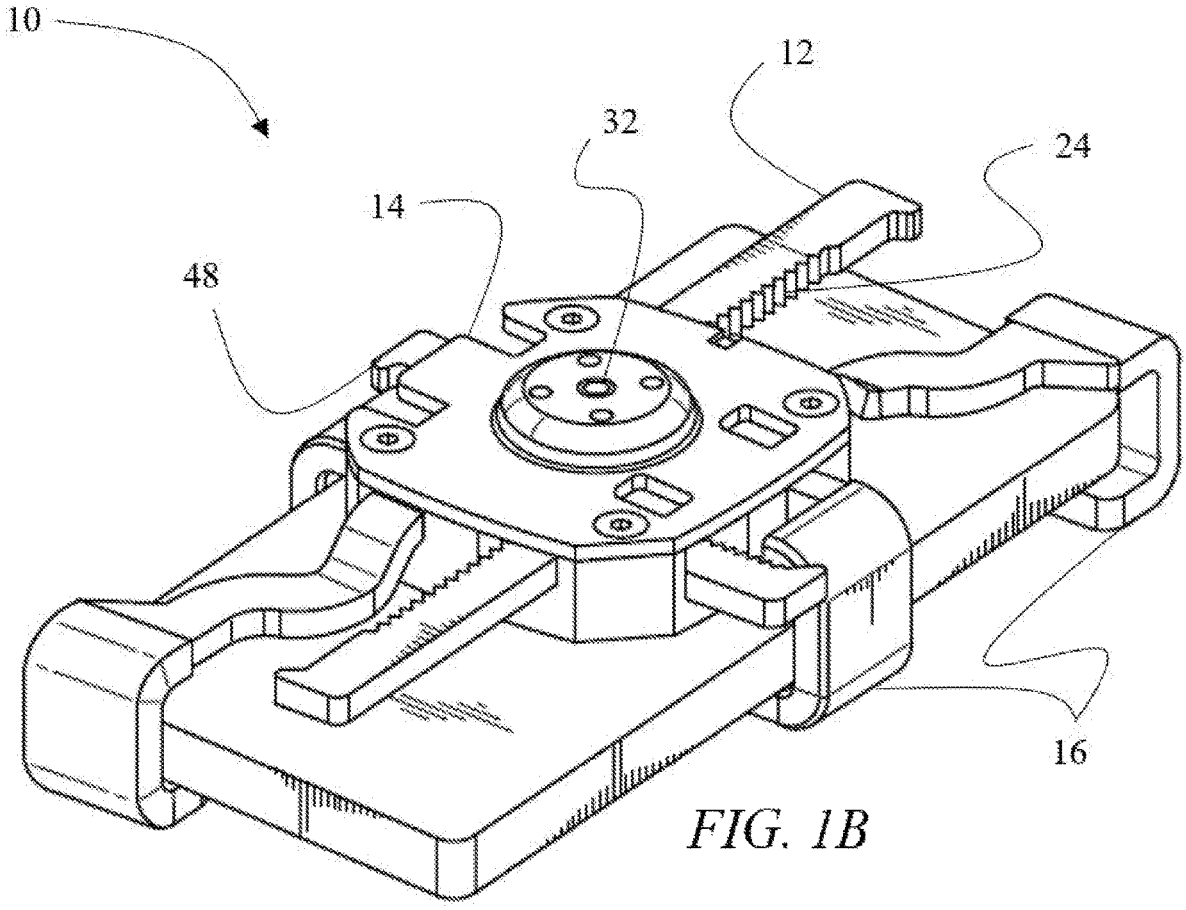
FIG. 1B is a perspective view of the anti-theft device securing an article of merchandise.

FIGS. 1A-B depict an anti-theft security device 10. Security device 10 has two sets of adjustable bracket arms 12 disposed within a housing 14. The distal end of each arm 12 has a C-shaped grip 16 configured to receive an edge of an article of merchandise. The two sets of adjustable arms 12 are in an orthogonal relationship with one another. The length of each arm 12 is independently adjustable by sliding arm 12 relative to housing 14. This configuration enables arms 12 to adjust to the geometry of the article of merchandise.

Referring to FIGS. 1A-B, the following is a description of the method of securing the article of merchandise within security device 10 and, subsequently, releasing the article of merchandise therefrom. When unlocked, arms 12 are configured to slide in a direction away from housing 14, thereby increasing a distance between opposite grips 16. When the distance between opposite grips 16 exceeds the dimensions of the article of merchandise, the article of merchandise can be positioned between grips 16. At this point, arms 12 can be manipulated to slide toward one another, thereby decreasing the distance between opposite grips 16 until they engage the edges of the article of merchandise. In this configuration, the article of merchandise is secured to housing 14 by grips 16. To release the article of merchandise from housing 14, arms 12 are manipulated to slide outward from housing 14, thereby increasing the distances between opposite grips 16. Once the distance between opposite grips 16 exceeds the dimensions of the article of merchandise, the article of merchandise can be removed from security device 10.

As depicted in FIG. 1A, in an embodiment the proximal end of each arm 12 has flange 48 that prevents arms 12 from completely sliding out of housing 14. Arms 12 are slidingly disposed within corresponding channels inside housing 14. The width of each channel is such that it exceeds the width of the arm but is less than the combined width of the arm and flange 48. Thus, flanges 48 secure arms 12 against removal from housing 14. Each arm 12 can slide a predetermined distance relative to housing 14. This distance is controlled by the length of the channels: when flanges 48 engage the entryway of the channel arms 12 cannot slide outwardly any further because flanges 48 cannot enter into the channels. This feature secures arms 12 inside housing 14, thus preventing arms 12 from becoming lost or misplaced and facilitating ease of operation by ensuring that arms 12 do not accidentally slide out of housing 14 during the process of securing the article of merchandise within security device 10.

To ensure that arms 12 cannot be manipulated by an unauthorized individual, security device 10 includes a locking mechanism 20, depicted in FIGS. 2A-2D. Arms 12 are disposed within housing 14 in an orthogonal relationship with one another, such that each longitudinal arm 12 overlaps two latitudinal arms 12. This configuration results in a rectangle being formed between overlapping arms 12, wherein the rectangle is defined by inner edges of arms 12. Each inner edge has a rack of gear teeth 24 disposed therealong.

Figure 2A:
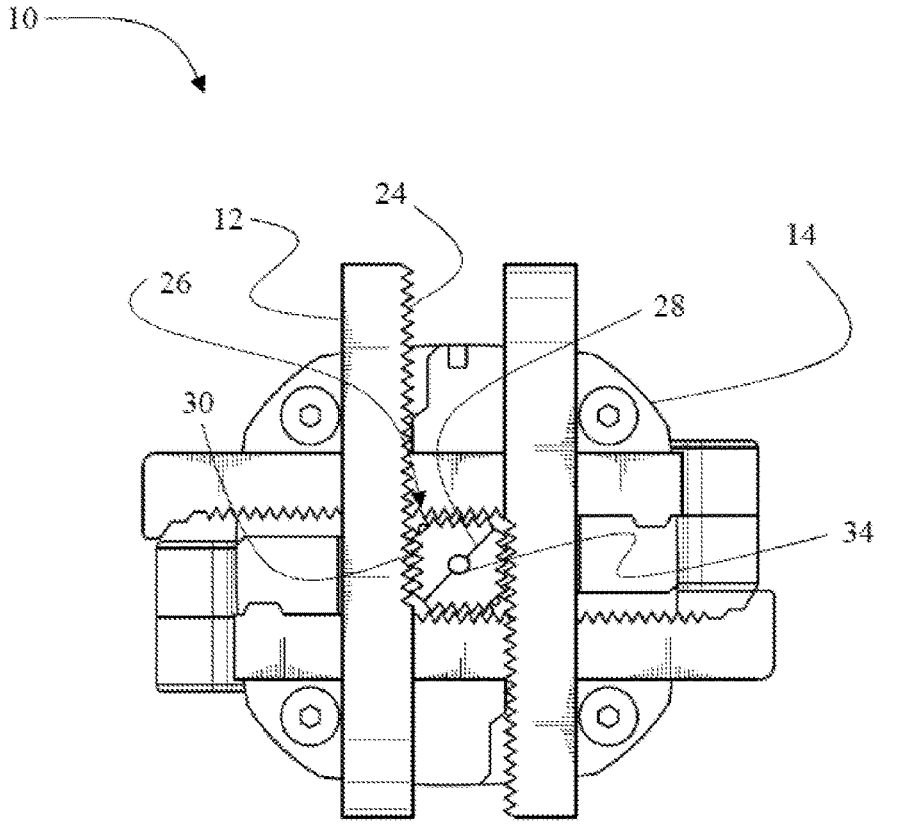
FIG. 2A is a top view of an embodiment of the anti-theft device in an unlocked configuration.
Figure 2B:
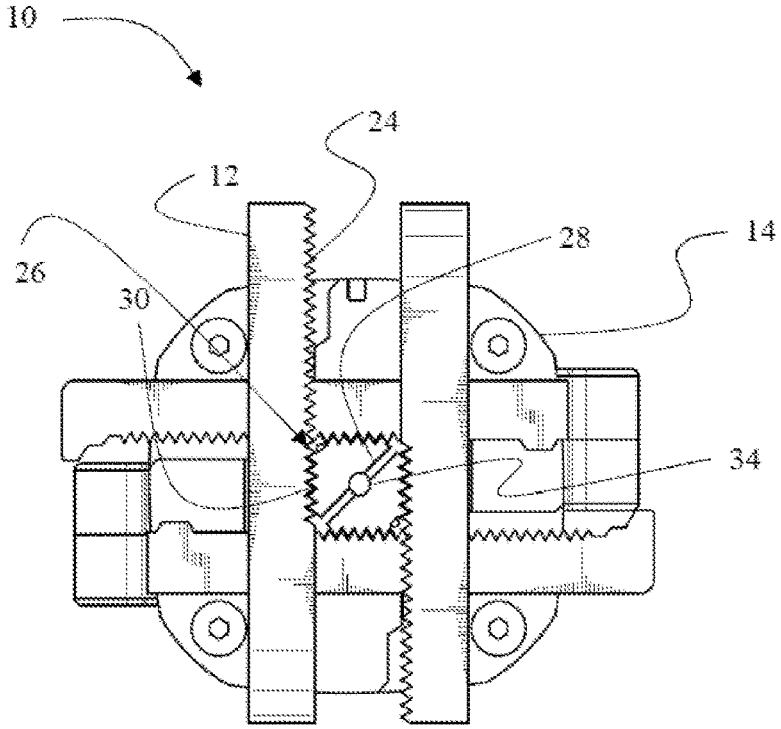
FIG. 2B is a top view of an embodiment of the anti-theft device in a locked configuration.
Figure 2C:
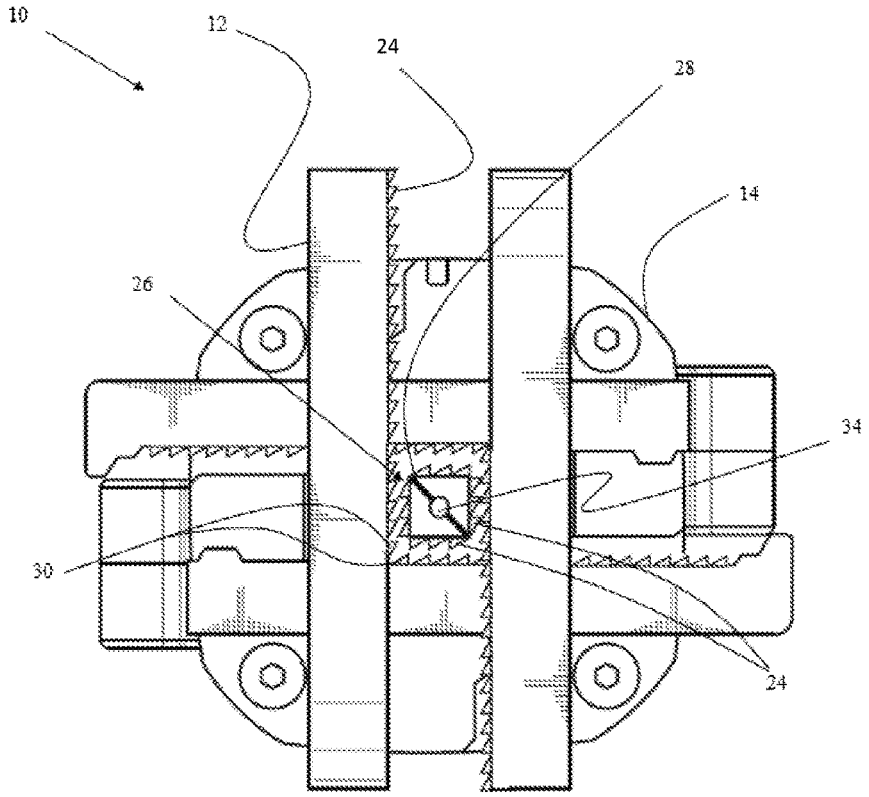
FIG. 2C is a top view of an embodiment of the anti-theft device in an unlocked configuration.
Figure 2D:
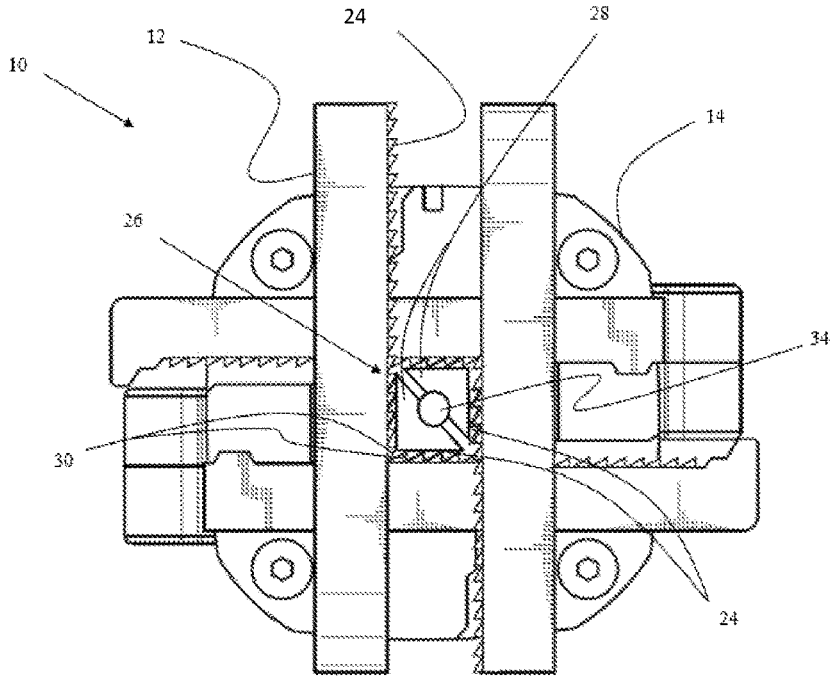
FIG. 2D is a top view of an embodiment of the anti-theft device in a locked configuration.

In an embodiment depicted in FIGS. 2C and 2D, gear teeth 30 and gear teeth 24 have right-triangular shapes with sloping sides. During the locking process, gear teeth 24 of locking components 28 apply forces onto sloping sides of gear teeth 30 of arms 12, thereby causing arms 12 to further slide inwardly relative housing 14. The geometries of the sloping sides of gear teeth 24 and 30 ensure that, when transitioning from an unlocked configuration to a locked configuration, arms 12 always slide inwardly relative to housing 14, thus causing grips 16 of arms 12 to securely grasp the edges of the article of merchandise. Gear teeth 30 and gear teeth 24 may be any geometric shape and/or different geometric shapes that one in the art would appreciate causing arms 12 to slide further toward housing 14 when gear teeth 30 engage gear teeth 24, securing the article of manufacture within security device 10.

As depicted in FIGS. 2A-2D, locking mechanism 20 is disposed within housing 14 inside the rectangle formed by overlapping bracket arms 12. Locking mechanism 26 comprises two locking components 28. Each locking component 28 has a right-triangular shape with a plurality of gear teeth 30 disposed along the legs of the right triangle. Gear teeth 30 are configured to interlock with gear teeth 24.

Locking components 28 are configured to transition between an unlocked configuration depicted in FIG. 2A into a locked configuration depicted in FIG. 2B. In the unlocked configuration, hypotenuse sides of two locking components 28 are in a close proximity or in an abutting relation with respect to one another. In this configuration, gear teeth 30 are disengaged from gear teeth 24, and, therefore, arms 12 are free to slide outwardly with respect to housing 14.

In the locked configuration, depicted in FIGS. 2B and 2D, locking components 28 are moved away from one another. In this configuration, gear teeth 30 of locking components 28 engage gear teeth 24 of arms 12. Because arms 12 in an orthogonal orientation with respect to one another, and because gear teeth 30 are disposed in a right-angle arrangement along the edges of the locking components 26, each locking component 28 is configured to simultaneously engage two arms 12. Thus, in the locked configuration, gear teeth 30 of two locking components 28 engage gear teeth 24 of all four arms 12. In this configuration, arms 12 are immobilized because interlocking of gear teeth 30 and gear teeth 24 restricts arms 12 against movement relative to housing 14. Therefore, when the article of merchandise is secured within grips 16, and security device 10 is in its locked configuration, the article of merchandise cannot be removed from grips 16 until locking components 28 are retracted, thereby releasing arms 12.

FIGS. 3A-C and 4A-B illustrate the mechanism and method of transitioning locking mechanism 24 between the locked and unlocked configurations. Housing 14 includes a port 32 disposed directly above the line at which hypotenuse edges of locking components 28 meet. An actuator 34 is disposed within the port 32. Actuator 34 is configured to translate along a vertical center axis of port 32, whereby actuator 34 can move in a downward direction toward locking components 28, and in an upward direction away from locking components 28. In an embodiment, port 32 and actuator 34 have complementary threads, whereby actuator 34 can be translated along the center axis of port 32 by clockwise or counterclockwise rotation. In other embodiments, various means known in the art for achieving a connection between a female port and a male component, whereby the male component is movable along the center axis of the female port can be implemented.

Figure 3A:
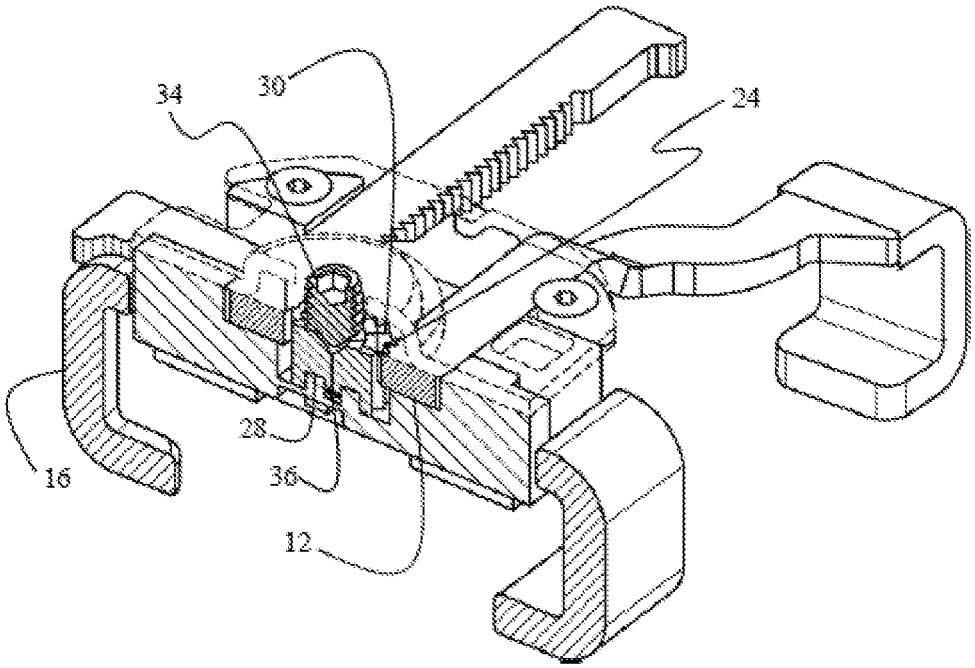
FIG. 3A is a perspective cut-away view of the anti-theft device in an unlocked configuration.
Figure 3B:
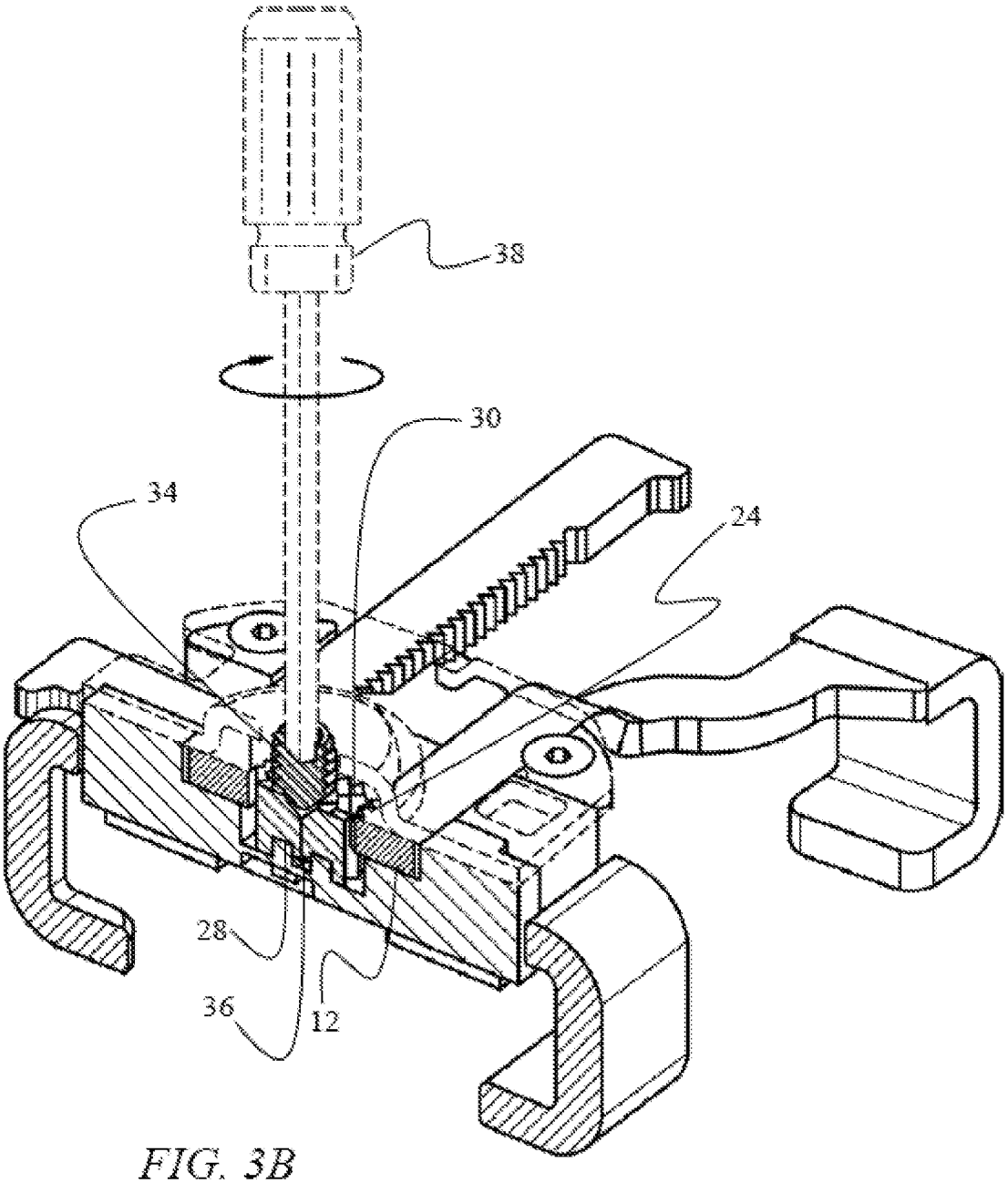
FIG. 3B is a perspective cut-away view of the anti-theft device in an unlocked configuration, wherein a semi-specialized tool is being used to operate the actuator.
Figure 3C:
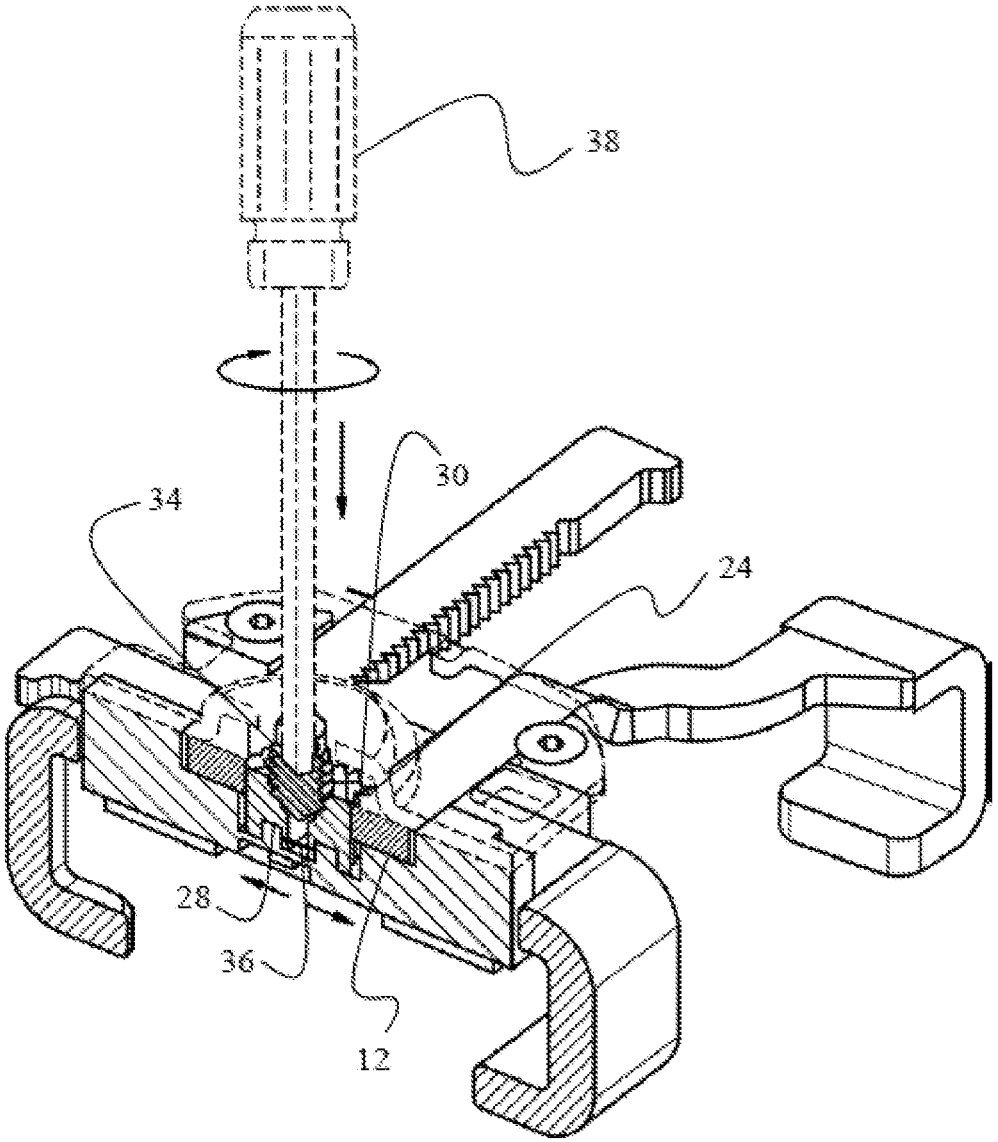
FIG. 3C is a perspective cut-away view of the anti-theft device in a locked configuration after the semi-specialized tool has been used to move the actuator.
Figure 4A:
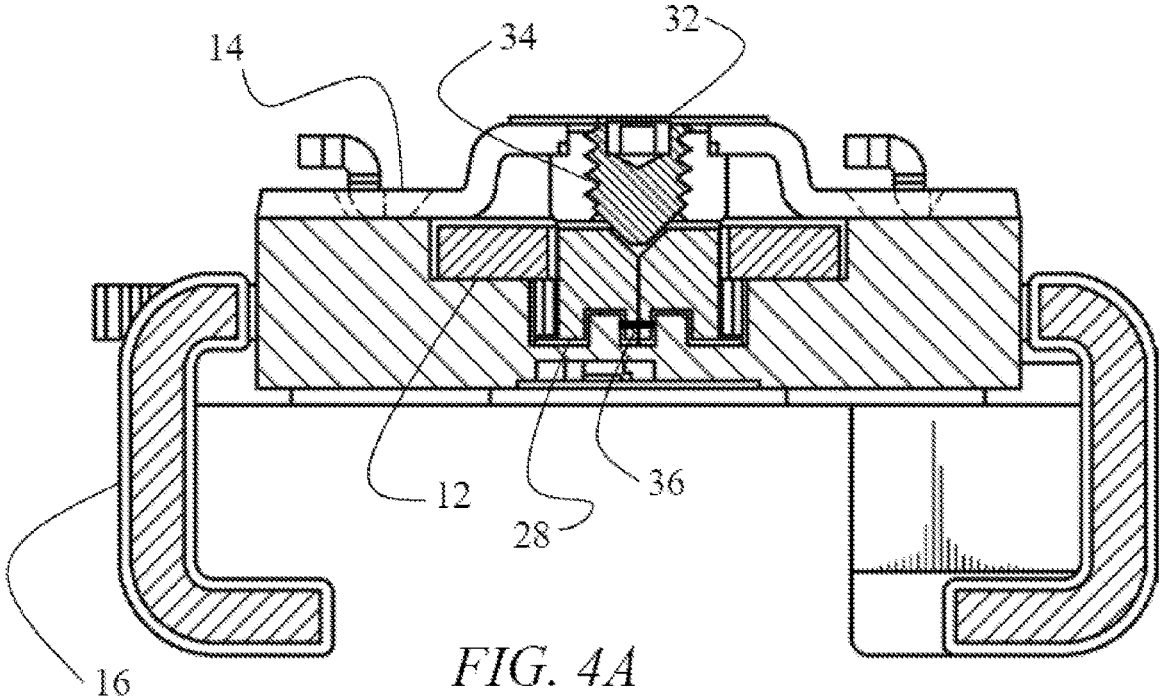
FIG. 4A is a front cut-away view of the anti-theft device in an unlocked configuration.

FIGS. 3A-C and 4A-B depict locking components 28 having sloping inner edges. Actuator 34 has a pointed distal end configured to engage the sloping edges of locking components 28. Locking components 28 are biased toward one another by a biasing element 36. Thus, as depicted in FIGS. 3A-B and 4A, when actuator 34 is in its retracted configuration, locking components 28 are biased toward one another. In this configuration, gear teeth 30 are retracted away from gear teeth 24, and, therefore, arms 12 are free to slide with respect to housing 14.

Figure 4B:
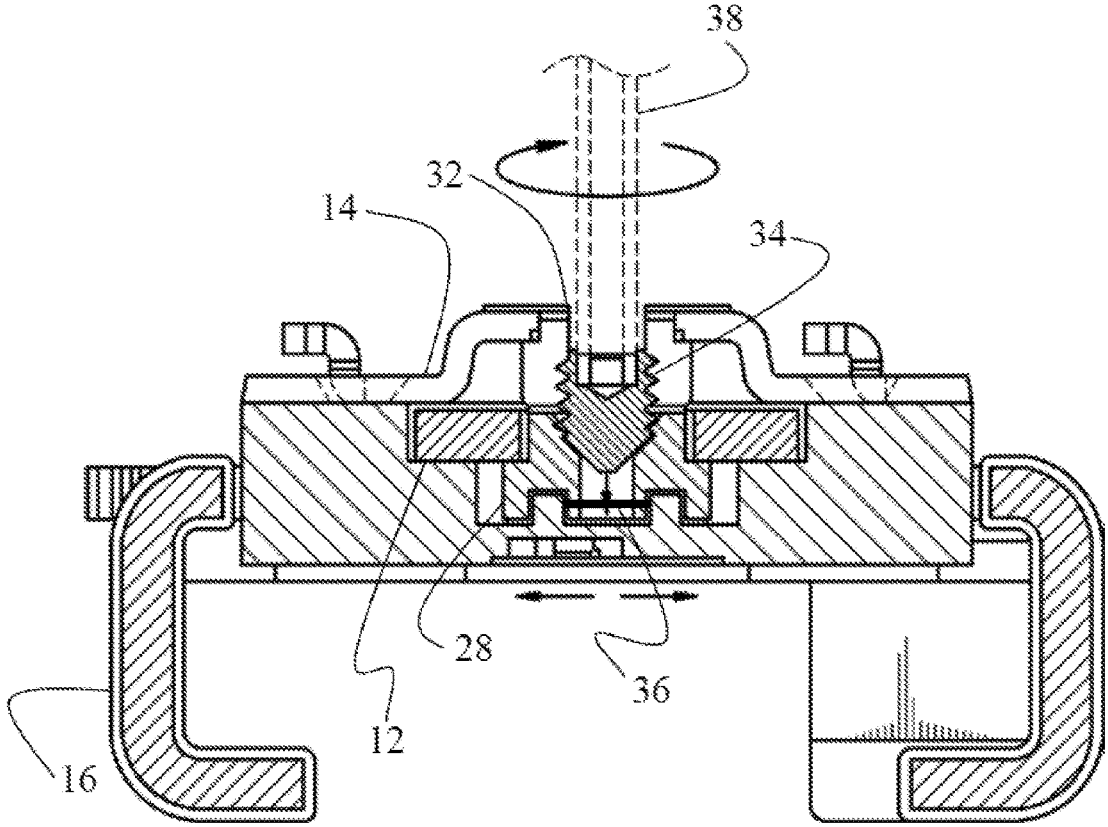
FIG. 4B is a front cut-away view of the anti-theft device in a locked configuration.

FIGS. 3B-C and 4B depict a semi-specialized tool 38 being used to manipulate actuator 34 in the embodiment in which port 32 and actuator 34 are in a screw-threaded engagement with one another. Clockwise rotation of tool 38 drives actuator downward. The pointed distal end of actuator 34 applies a force onto the sloping edges of locking members 28. Because the edges of locking members 28 and the pointed distal end of actuator 34 have complementary slopes, the force applied onto locking members 28 by actuator 34 has a horizontal component. The horizontal component of the applied force exceeds the biasing force exerted by biasing element 36, thereby causing locking members 28 to slide apart toward the position depicted in FIGS. 3C and 4B. In this configuration, gear teeth 30 of locking components 28 engage gear teeth 30 disposed along inner edges of arms 12, thereby immobilizing arms 12 within housing 14. This is the locked configuration of security device 10.

To transition security device 10 into the unlocked configuration, an authorized personnel member in possession of tool 38 uses tool 38 to rotate actuator 34 in a counterclockwise direction, thereby retracting actuator away from locking components 28. Biasing element 36 pulls locking components 28 toward each other, thereby disengaging gear teeth 30 from gear teeth 24. When the gear teeth 30 fully disengage gear teeth 24, security device 10 is in the unlocked configuration and lengths of arms 12 can be adjusted, thereby releasing the article of merchandise from grips 16.

Figure 4C:
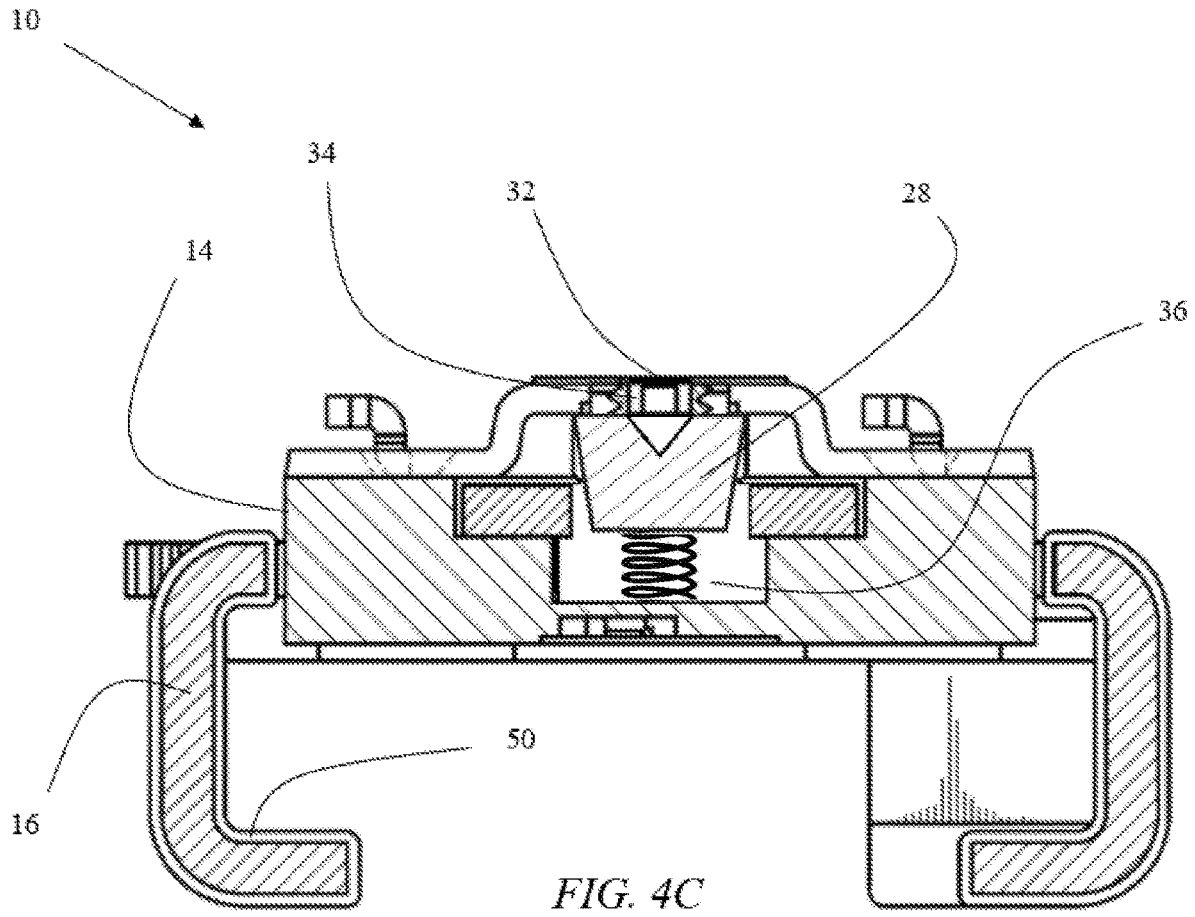
FIG. 4C is side cut-away view of an embodiment of the anti-theft device depicting the locking member in an unlocked configuration.
Figure 4D:
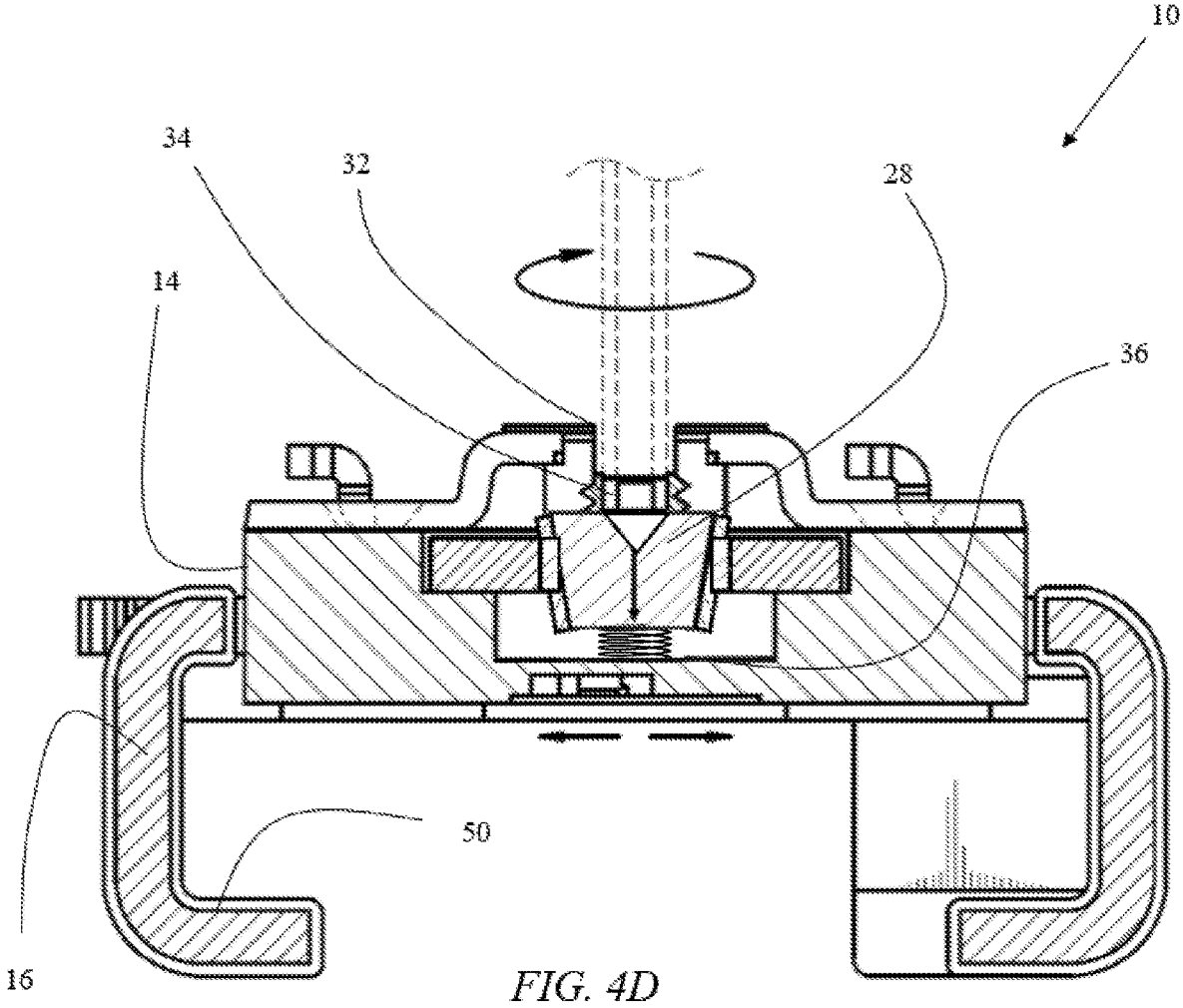
FIG. 4D is a side cut-away view of an embodiment of the anti-theft device depicting the locking member in a locked configuration.

In an embodiment depicted in FIGS. 4C and 4D, grips 16 are encased by sleeves 50. Sleeves 50 may be made of an elastomeric material having an elastic limit that is greater than that of the of a maximum force exerted on the elastomeric material 50 by the article of merchandise when security device 10 is in the locked configuration. Elastomeric material 50 is nonconductive and allows for an article of manufacture to retain full functionality while secured within grips 16 (e.g., when grips 16 secure a cellular device within the security device 10 the elastomeric material does not interfere with the use of the touch screen of the cellular device). Some examples of acceptable elastomeric materials include ethylene propylene rubber, silicone rubber, fluoroelastomers, and any other material that one of ordinary skill in the art would appreciate to protect an article of manufacture from damage while being secured in security device 10.

FIGS. 4C and 4D depict a semi-specialized tool 38 being used to manipulate actuator 34 in the embodiment in which port 32 and actuator 34 are in a screw-threaded engagement with one another. Clockwise rotation of tool 38 drives actuator downward. The pointed distal end of actuator 34 applies a force onto the sloping edges of locking member 28. Because the edges of locking members 28 and the pointed distal end of actuator 34 have complementary slopes, the force applied onto locking members 28 by actuator 34 has a vertical component. The vertical component of the applied force exceeds the biasing force exerted by biasing element 36, thereby causing locking members 28 to translate vertically toward the position depicted in FIG. 2B. In this configuration, gear teeth 30 of locking components 28 engage gear teeth 30 disposed along inner edges of arms 12, thereby immobilizing arms 12 within housing 14. This is the locked configuration of security device 10.

Figure 5A:
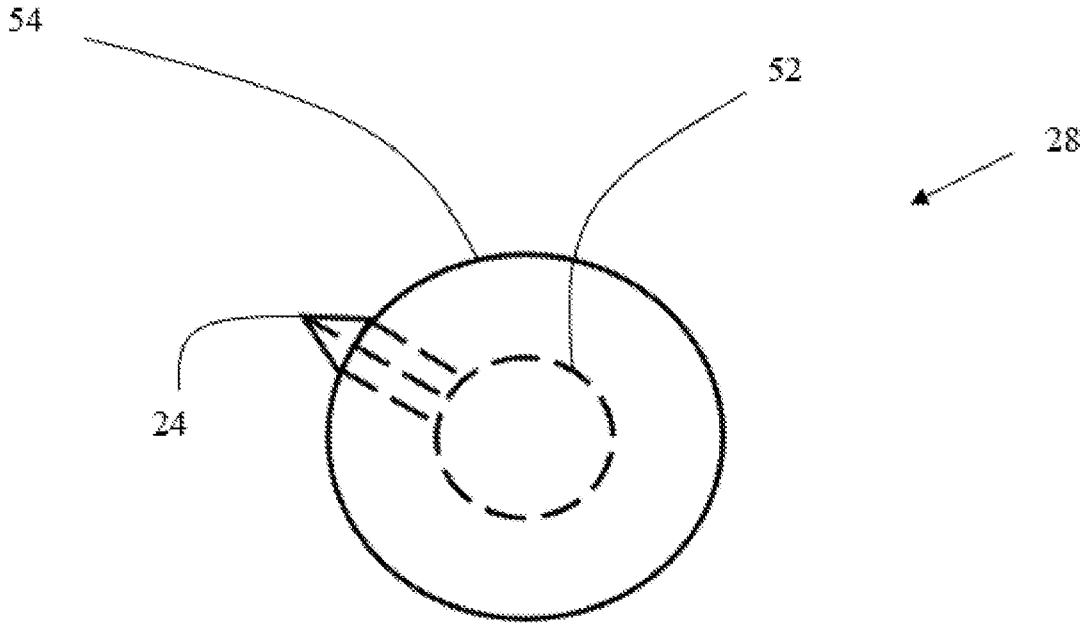
FIG. 5A is a top view of the frustoconically-shaped locking member.
Figure 5B:
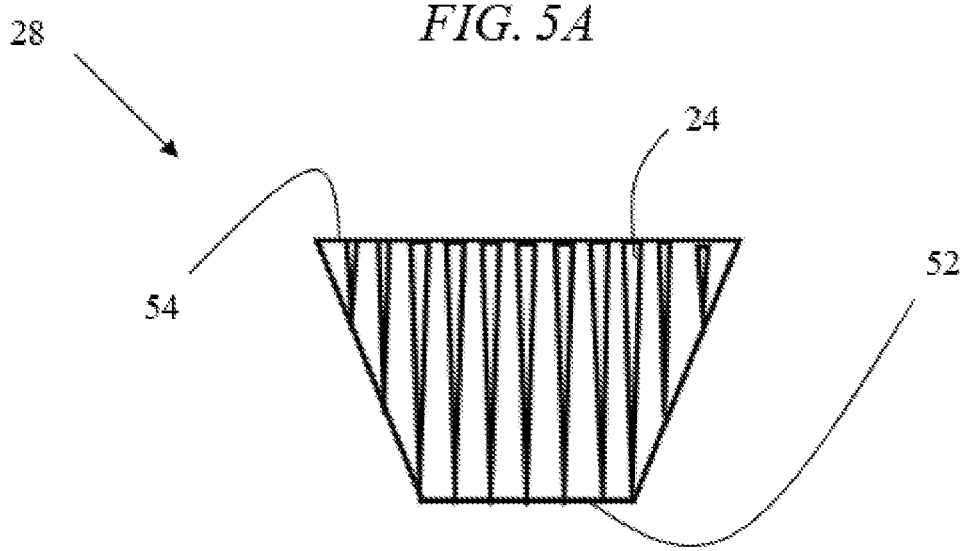
FIG. 5B is a side view of the locking member depicting gear teeth disposed on the outside surface thereof.

FIGS. 5A and 5B depict an alternative embodiment of locking member 28. Locking member 28 has a frustoconical shape having gear teeth 24 disposed along an outside surface of locking member 28 extending along a longitudinal extent formed between first smaller circumference 52 and second larger circumference 54. Gear teeth 24 have complementary shapes to gear teeth 30 and protrude radially relative locking member 28 such that when actuator 34 drives locking member 28 toward arms 12, gear teeth 24 engage gear teeth 30, thereby immobilizing arms 12 within housing 14.

To transition security device 10 into the unlocked configuration, an authorized personnel member in possession of tool 38 uses tool 38 to rotate actuator 34 in a counterclockwise direction, thereby retracting locking component 28. Biasing element 36 urges locking component 28 toward port 32, thereby disengaging gear teeth 30 from gear teeth 24. When the gear teeth 30 fully disengage gear teeth 24, security device 10 is in the unlocked configuration and lengths of arms 12 can be adjusted, thereby releasing the article of merchandise from grips 16.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An anti-theft device for securing an article of merchandise, comprising:

a housing;

a first pair of arms and a second pair of arms slidingly disposed within the housing, the first pair of arms being in an orthogonal orientation relative to the second pair of arms, wherein a length of each arm extending beyond the housing is independently adjustable by sliding the arm inwardly or outwardly with respect to the housing;

a grip disposed at an end of each arm, each grip configured to receive an edge of the article of merchandise;

a first set of gear teeth disposed along each arm;

a locking component disposed within the housing, wherein the locking component is non-rotational;

a second set of gear teeth disposed on an outer surface of the locking component, the second set of gear teeth disposed on the locking component configured to interlock with the first set of gear teeth disposed along the arms, whereby the anti-theft device has a first unlocked configuration in which the locking component is radially or axially retracted away from the arms such that the first and the second sets of gear teeth are disengaged, and a second locked configuration in which the first and the second sets of gear teeth are interlocked, wherein to adjust the length of each arm extending beyond the housing, the second set of gear teeth must be disengaged from the first set of gear teeth; and an actuator disposed within the housing, the actuator configured to apply a force onto the locking component to transition the locking component from the first unlocked configuration into the second locked configuration, thereby immobilizing the arms within the housing.

2. The anti-theft security device of claim 1, wherein each arm comprises a flange configured to retain the arm within the housing.

3. The anti-theft security device of claim 1, wherein at least one gear tooth of the first set of gear teeth has a sloped side, such that when the locking component engages the sloped side of the gear tooth, the arms slide inwardly relative to the housing.

4. The anti-theft security device of claim 1, wherein the grip is encased by a sleeve configured to undergo elastic deformation responsive to being pressed against the edge of the article of merchandise.

5. The anti-theft security device of claim 4, wherein the sleeve is non-conductive.

6. The anti-theft security device of claim 4, wherein the sleeve is made of an elastomeric material.

7. The anti-theft security device of claim 1, further comprising a biasing element configured to displace the locking component away from the first and the second pair of arms, thereby urging the locking component toward the first unlocked configuration.

8. The anti-theft security device of claim 7, wherein the force applied onto the locking component by the actuator exceeds a biasing force exerted onto the locking component by the biasing element.

9. The anti-theft security device of claim 1, wherein the actuator is screw-threadedly disposed within the housing, whereby rotation of the actuator about a longitudinal center axis thereof causes the actuator to apply the force onto the locking component.

10. The anti-theft security device of claim 1, wherein the locking component has a frustoconical shape, and wherein the second set of gear teeth is disposed along the outer surface of the frustoconical shape.

11. The anti-theft security device of claim 1, wherein the housing has a female port in which the actuator resides, the female port having an opening on a first surface of the housing opposite to a second surface of the housing facing the article of merchandise, thereby enabling access to the actuator when the article of merchandise is secured within the anti-theft device.

12. A method of securing an article of merchandise within an anti-theft device, comprising:

receiving the anti-theft device having a housing and four arms slidingly disposed therein, each arm having a grip disposed on an end thereof;

extending four arms of the anti-theft security by sliding each arm out of the housing;

positioning an article of merchandise between the grips;

retracting the arms into the housing such that each grip receives an edge of the article of merchandise;

operating an actuator disposed within the housing to transition the anti-theft device from a first unlocked configuration into a second locked configuration, wherein operation of the actuator causes the actuator to apply a force onto a locking component residing within the housing, thereby causing the locking component to radially or axially translate within the housing toward the arms until the locking component engages the arms, wherein the locking component is non-rotational and wherein in the first unlocked configuration the locking component is retracted away from the arms;

wherein a first set of gear teeth is disposed along the arms and a second set of gear teeth is disposed on the locking component, whereby, in the second locked configuration, the second set of gear teeth disposed on the locking component interlocks the first set of gear teeth disposed along the arms, thereby immobilizing the arms within the housing and retaining the article of merchandise within the grips, wherein to extend each arm, the second set of gear teeth must be disengaged from the first set of gear teeth.

13. The method of claim 12, wherein a biasing element is disposed within the housing and is configured to retract locking component away from the arms, thereby urging the anti-theft device into the first unlocked configuration.

14. The method of claim 13, wherein the force applied onto the locking component by the actuator exceeds the biasing force exerted by the biasing element.

15. The method of claim 12, wherein the actuator is screw-threadedly disposed within the housing, whereby operation of the actuator involves rotation of the actuator about its longitudinal center axis.

16. The method of claim 12, wherein the locking component is configured to immobilize two arms, wherein the two arms being immobilized are in an orthogonal orientation with one another.

17. The method of claim 12, wherein the locking component has a frustoconical shape, and wherein the second set of gear teeth is disposed along the outer surface thereof.

18. The method of claim 12, wherein the locking component has a partially sloped recess and the actuator has a pointed distal end engaging the sloped recess.

19. The method of claim 12, wherein the housing has a female port in which the actuator resides, the female port having an opening on a first surface of the housing opposite to a second surface of the housing facing the article of merchandise, thereby enabling access to the actuator when the article of merchandise is secured within the anti-theft device.

20. The method of claim 12, wherein each arm comprises a flange configured to retain the arm within the housing.

21. The method of claim 12, wherein at least one tooth of the first set of gear teeth has a sloped side, such that when the locking component engages the sloped sides of the at least one gear tooth, the arms slide inwardly relative to the housing.

22. The method of claim 12, wherein each grip is encased by a sleeve configured to undergo elastic deformation responsive to being pressed against the edge of the article of merchandise.

23. The method of claim 22, wherein the sleeve is non-conductive.

* * * * *